US006449930B2

(12) United States Patent
Robart et al.

(10) Patent No.: US 6,449,930 B2
(45) **Date of Patent: *Sep. 17, 2002**

(54) PINCHLESS BRIDLE BIT

(75) Inventors: David Robart, 2890 County Rd. 166, Elizabeth, CO (US) 80107; Glenice Robart, 2890 County Rd. 166, Elizabeth, CO (US) 80107

(73) Assignees: Glenice Robart, Snow Hill, NC (US); David Robart, Snow Hill, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,800

(22) Filed: Jan. 19, 1999

Related U.S. Application Data

(63) Continuation-in-part of application No. 09/092,706, filed on Jun. 5, 1998, now Pat. No. 6,347,501.

(51) Int. Cl.[7] ..... B68B 1/06
(52) U.S. Cl. ..... 54/8; 54/9
(58) Field of Search ..... 54/7, 8, 9

(56) References Cited

U.S. PATENT DOCUMENTS

| | | | | | |
|---|---|---|---|---|---|
| 328,975 | A | * | 10/1885 | Roberts | 54/9 |
| 368,776 | A | * | 8/1887 | Manning | 54/8 |
| 479,670 | A | * | 7/1892 | Sloat | 54/7 |
| 664,970 | A | * | 1/1901 | Richter | 54/8 |
| 891,419 | A | * | 6/1908 | Herbert | 54/7 |
| 962,134 | A | * | 6/1910 | Engle | 54/7 |
| 1,091,683 | A | * | 3/1914 | Mateer | 54/8 |
| 1,128,631 | A | * | 2/1915 | Smith | 54/7 |
| 1,258,145 | A | * | 3/1918 | Rowley | 54/7 |
| 3,205,636 | A | * | 9/1965 | Laningham | 54/8 |
| 3,208,196 | A | * | 9/1965 | Ferguson | 54/8 |
| 3,623,294 | A | * | 11/1971 | Stone et al. | 54/8 |
| 3,851,446 | A | * | 12/1974 | Bischeltsrieder | 54/8 |
| 4,005,564 | A | * | 2/1977 | Simington | 54/8 |
| 5,822,950 | A | * | 10/1998 | Moya et al. | 54/8 |

FOREIGN PATENT DOCUMENTS

| | | | | |
|---|---|---|---|---|
| DE | 4423560 | * | 7/1994 | 54/8 |
| FR | 2612506 | * | 5/1987 | 54/8 |

* cited by examiner

*Primary Examiner*—Peter M. Poon
*Assistant Examiner*—Son T. Nguyen

(57) ABSTRACT

An improved bridle bit is described that is useful for training an animal, for example, a horse. Said bit comprises a bar or bars to be received in the mouth of an animal, said bars having internally disposed therein, one or a plurality of bushings providing mouthpiece rotational movement, one or a plurality of spring elements providing return movement and cheek pieces providing traditional rein and headstall ring members for bridle assembly attachment. The invention may be used, for example, for the pinch and/or pain free training, control or correction of horses.

7 Claims, 10 Drawing Sheets

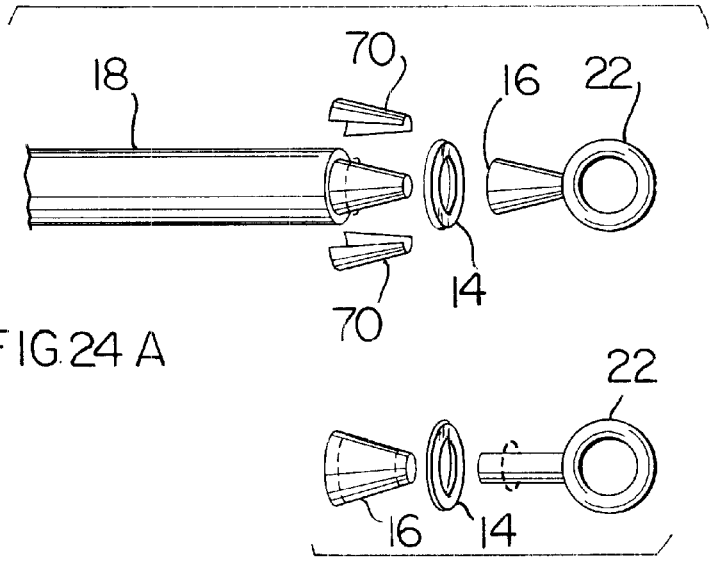
FIG. 24 A
FIG. 24B
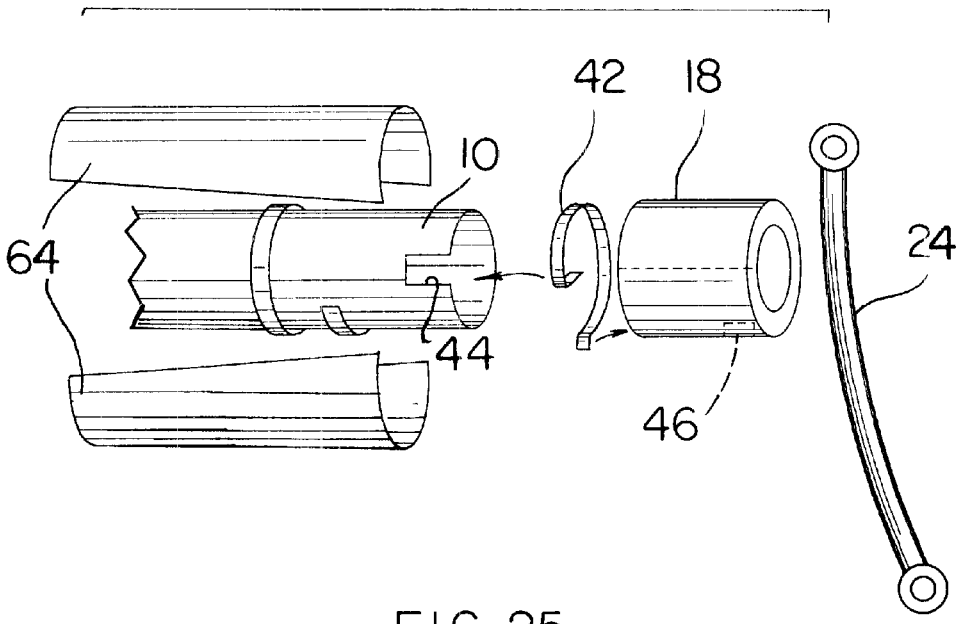
FIG. 25

PINCHLESS BRIDLE BIT

RELATED APPLICATIONS

This application is a continuation-in-part of the application having U.S. Ser. No. 09/092,706, filed on Jun. 5, 1998 now U.S. Pat. No. 6,347,501; said application is based on the invention disclosure filed under the Document Disclosure Program, disclosure document number 431562; the instant application is based on an additional invention disclosure filed under the Document Disclosure Program, disclosure document number 445096. The earlier filing date of this application is hereby claimed.

FIELD OF INVENTION

This invention relates to the general fields of animal training and devices therefor. Specifically, the instant application is directed to a novel bridle bit that employs one or a plurality of bushings, said bushings enabling the complete control of separate portions of the bit and preventing pinching or pain inducing stimuli. The instant bit further employs one or a plurality of spring elements for facilitating independent bit portion control and/or the effort free return of the separate portions of the bit to their original positions subsequent to engagement thereof. The present invention, thus, relates to the art of controlling and training bittable animals, for example, horses, through the use of mouth bits, bit assemblies and devices related thereto.

BACKGROUND AND PRIOR ART

Bridle bits and bitting systems have been used all over the world for centuries as a means of communication between the horse and its rider. They are used to communicate to the horse what the rider wishes the horse to do. In fact, horse training is, in large, communication. Without communication between the trainer and trainee, very little, if any, training takes place. Most present day horse training is pressure and pain avoidance training. That is, training via the use of tactile stimuli. Such training is, for example, where pressure is applied and when the horse gives to the pressure, the pressure is released. Thus, use of tactile stimuli has practical application to the control of horse behavior, because horses are controlled by riders through the delivery of tactile stimuli, often called aids by riders. These stimuli are most often given in one of three ways to the horse: to the horses's mouth with the bit, to the sides of the horse with the rider's legs, or to the horses back with the rider's posture or position in the saddle. Thus, there is widespread use of tactile stimuli to control behavior of horses, as it is an effective stimulus for horses. Dougherty and Lewis (1993) J. Exp. Anal. Behav. 59:521.

Commonly used pressure avoidance training may be effected by a leg, a shifting of the rider's weight or the reins and bit. Pain avoidance training is similar. In fact, most currently commercially available bits use this technique—give to the bit and pain is avoided. Some avoidance training is further reinforced using spurs, crops or whips. This type of training works, but it limits the communication between the horse and trainer by causing stress to both parties. Stress lowers the learning ability of all human and non-human animals. Specifically, when a horse is scared of making a mistake it is avoiding correction. That is, avoiding pain. This takes energy and keeps the horse in a defensive mode or posture. Horses are flight-oriented animals and are strong. Attempts at training are ineffective if the horse is not calm enough to receive the training stimuli. That is, listen to what is being communicated.

Bridle bits are generally used by the rider as a means of control or correction. Therefore, a horse is corrected for undesirable behavior but receives nothing for correct behavior. This methodology limits the trainer to pressure and pain avoidance training. That is, using punishment and correction for what is generally called aversive stimulation training. With the use of only corrections for undesirable behavior, the horse is caused higher levels of stress and prevented from reaching its full potential of learning ability. Horses' bits, a primary source of aversive stimulation, are carefully designed to allow the delivery of a punishing stimulus to the horse in a sensitive area with little effort by the rider. This is accomplished by a system of leather straps that hold the bit in the horse's mouth—collectively, called the bridle. By putting pressure on the reins attached to the bit, the rider brings the bit to bear on the horse's jaw bones. At rest, the bit sits on the horse's jaw bone, fitting comfortably into natural spaces between the horse's teeth. These very sensitive bones are easily stimulated by putting tension on the reins attached to the bit. Thus, the horse's behavior is readily reinforced by escape and avoidance of this punishing, or aversive, stimuli.

An understanding of the conditioning processes involved in training horses is lost because of two confusing factors. One is that the reins, through their attachment to the bit, are used to deliver both non-aversive and aversive stimuli. The other factor, horses' behavior problems can arise from a training regimen that fails to employ appropriate conditioning techniques or employs techniques that give the horse mixed messages. On the other hand, positive reinforcement training assists a horse in being motivated and enthusiastic in learning. This approach, in turn, lowers stress and decreases errors. Using only corrections causes higher stress in the horse and prevents the use of the horse's full learning and performance potential.

No satisfactory solution to the problem of limiting a horses learning ability through pressure and pain avoidance training has been provided thus far. Current bridle bit technology has enabled numerous variations on a theme to be commercially marketed. That is, various bit configurations that are all based on pain avoidance and negative reinforcement. The prior art discloses several different types of horse bits having bushings and/or rotatable parts. U.S. Pat. No. 103,103 to Swan, describes a pressure producing bridle bit having bars joined together in the center by a swivel-joint that consists of a barrel and a cylindrical nut allowing adjustment of either side of the bar against the corner of a horse's mouth.

U.S. Pat. No. 623,333 to Payne, discloses an improved bridle bit. Said bit is useful for avoiding chafing or irritation to a horse's mouth by allowing the free lateral movement of the rein-bar while the tubular mouthpiece's position remains unchanged.

Blyhoder and Hughes, U.S. Pat. No. 296,815, describe a hollow or tubular, T-shaped bridle bit with rings on either end thereof. Said bit is intended for preventing the adverse habit of wind-sucking.

A bridle bit having a mouthpiece with a centrally depressed portion provided with a covering or ball which is rotatably pressed against the roof of the horses mouth in use is disclosed in U.S. Pat. No. 529,472 to Bigelow.

Next, U.S. Pat. No. 1,091,683 to Mateer, describes a discloses an improved bridle bit having a medicine cup interposed between outer bar sections of the mouthpiece, said medicine cup engaged via swivel joint. Said bit is useful for the administration of medicine and aversive training.

Fryer, U.S. Pat. No. 2,193,451, discloses a loose jaw curb bit having adjustable cheek piece movement limitations. That is to say, having cheek pieces that are moveably connected to the mouthpiece via an adjustable universal ball and joint connection.

The curb-type bridle bit disclosed in U.S. Pat. No. 2,488,977 to Johnson comprises a conventional curb bit providing the ability to rock the bit in the horse's mouth via a bearing means disposed at either lateral end of the bar, between said bar and cheek pieces.

Sauter, U.S. Pat. No. 2,931,154, teaches an animal controlling apparatus that may be substituted for a bridle bit, which apparatus is use useful for animal control with a minimum of discomfort thereto.

A snaffle bit comprising a pair of bar parts joined by an elastic hinge is disclosed in U.S. Pat. No. 3,851,446 to Bischeltsrieder. The object of said bit it to provide a single bit having variable widths.

U.S. Pat. No. 4,005,564 to Simington teaches a bit having bar arms pivotally connected, via ball and socket joints, to a center coupling pacifier for eliminating objectionable mannerisms, e.g., tongue protruding, teeth grinding, and lip smacking.

Fry, U.S. Pat. No. 5,357,735, discloses an adjustable horse bit, the object of which is to provide a bit having the capability to adjust to various widths in order to accommodate different sized horse mouths.

U.S. Pat. No. 5,062,255 to Myler et al. discloses a bridle bit having a mouthpiece with independently movable cheek pieces at each end and rotatable head stall and rein ring connections fore and aft of the cheek pieces.

None of the currently commercially available bridle bits enable the rider or driver to independently work portions of the bridle bit without pinching, or causing irritation, to the horse's mouth. The present invention overcomes this prior art shortcomings by allowing the user independently manipulate the bar or bars and/or the cheek pieces of the bit without employing conventional pain avoidance techniques. That is, the instant invention is pinchless by virtue of its construction, including one or more internally disposed bushings and one or more spring elements, providing rotational movement without pinching the horse's tongue. While prior art devices are suitable for pure control via pressure and pain avoidance, they cannot be efficiently and effectively used for pinchless animal training in that they twist, swivel, or the like. The present invention, however, provides improved bridle bits that enable the rider or driver to correct an animal in a pinch free manner. The invention described herein is made from any or all of the currently available substances and variations generally used with bits and bridles. The current invention, thus, provides for novel bridle bits for controlling or training a horse without causing injury, pain or stress to the horse. Therefore, apparatuses made according to the present invention are completely safe and effective for their intended use.

An object of the present invention is to provide a bit having one or more points of rotation for bar and/or cheek piece maneuverability without producing the pinching or pain producing action of currently available bits. A further object of the present invention is to move the port and right portions, or alternatively, port and left portions of the bit independently, as well as facilitate the effort free return of the separate portions of the bit to their original positions subsequent to engagement thereof.

Another object of the present invention is to provide bars having the ability to rotate from 0–360 degrees, or alternatively, further comprise a limiter or stop that enables the adjustment and limitation of degrees of rotation.

An additional object of the invention is to provide a bit that is allowed under nationally recognized horse show rules, e.g., American Horse Show Association, in the show ring.

Yet another object of the present invention is to provide a humane, non-human animal training aid.

Additionally, the present invention provides bridle bits that achieve the above disclosed objectives and yet are be easily applied to and used on a horse without any special skills or training of the rider or driver.

SUMMARY OF THE INVENTION

This invention is based on a novel concept for improved bridle bits—bits having the specific rotatable bushings disclosed herein, or other rotatable couplers, as well as at least one spring element, each internally disposed within the bar or bars of the bit. The invention relies on the principals of behavior modification psychology and general animal training in that pain avoidance training is obviated by its use. The present invention is defined by a bar or bars, one or more internally disposed rotatable couplers, i.e., bushings, one or more internally disposed spring elements, e.g., leaf, coil, helical or torsional, a plurality of cheek pieces functionally attached to said bar or bars and having cheekpieces, ring or shank members, mounted thereon.

The present invention is an improved bridle bit that permits the control and/or correction of a horse without inflicting pain, thereby reducing stress and increasing learning potential. The present invention is applicable to all styles of bits, bit assemblies and derivatives thereof. Furthermore, it is suitable for the training of all non-human animals capable of accepting a bit. The present invention is useful for training and long term control and/or correction of non-human animals, i.e., horses, but is not intended to be limited to these uses.

In a first preferred embodiment of the invention, a pinchless snaffle configuration is disclosed, wherein, within each half of the mouthpiece an internal bushing is disposed laterally between the body of the bar and the standard central snaffle ring. When the rider or driver engages either one of both of the reins, the two halves of the mouthpiece rotate independent of one another without producing the pinching action of conventional snaffles.

Alternative embodiments of the instant invention include integration of various conventional bit configurations with the novel internal rotatable coupler (bushing) disclosed herein. More specifically, bit configurations known in the art include, for example, O-, D-, and full cheek ringed snaffles, hidden mullen barrels, hinged snaffles, french link snaffles, twists, life savers, ported and unported curbs, straight bars, and half-breed correctional bits.

Another preferred embodiment is directed to the first preferred embodiment, further comprising a plurality of spring elements functionally combined with a bushing of the instant invention. Thus, the combination thereof further facilitates independent bit portion control in addition to the effort free return of the separate portions of the bit to their original positions subsequent to engagement thereof.

The instant invention provides the rider or driver an alternative means of communication with the animal being trained—as opposed to traditionally used control and pain avoidance techniques. Other features and advantages of the present invention will become apparent from the following detailed description, taken in conjunction with the accompanying figures, that illustrate by way of example, the principles of the instant invention.

BRIEF DESCRIPTION OF THE FIGURES

FIG. 21*a* shows the bit assembled and FIG. 21*b* is an exploded view of the rotational coupling.

FIG. 24 depicts an alternate rotatable coupler for incorporation and use with all standard bit configurations to achieve pinchless rotation and independent portion movement thereof.

FIG. 25 provides an alternate embodiment of the spring containing preferred embodiment of the instant invention.

Figure 1:
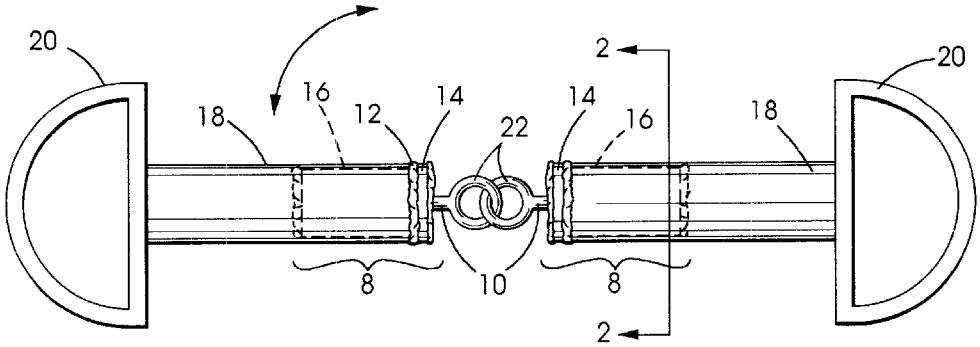
FIG. 1 is a perspective view of the bit mouth piece of the first preferred embodiment of the present invention.

| REFERENCE NUMERALS IN FIGURES | |
|---|---|
| 8 | bushing |
| 10 | shaft |
| 12 | shaft sleeve |
| 14 | internal sleeve ring |
| 16 | bushing sleeve |
| 18 | bar |
| 20 | D-ring member |
| 22 | center O-ring |
| 24 | shank ring member |
| 26 | O-ring member |
| 28 | limiter |
| 30 | hinge |
| 32 | french link |
| 34 | barrel |
| 36 | roller |
| 38 | plate |
| 40 | shaft aperture |
| 42 | spring element |
| 44 | first spring element stop |

-continued

| REFERENCE NUMERALS IN FIGURES | |
|---|---|
| 46 | second spring element stop |
| 48 | male peg coupler element |
| 50 | female ring coupler element |
| 52 | allen screws |
| 54 | external sleeve ring |
| 56 | screw groove |
| 58 | screw bore |
| 60 | shaft lip |
| 62 | external sleeve |
| 64 | external protective sleeve |
| 66 | cheekpiece |
| 68 | barrel/port portion |
| 70 | half conical-shaped lipped sleeve |
| 72 | shaft stop |
| 74 | bar aperture |

DETAILED DESCRIPTION OF THE PREFERRED EMBODIMENT

It is to be understood that both the foregoing general description and the following detailed description are exemplary and explanatory only and are not restrictive of the invention as claimed.

The following definitions are helpful in understanding the specification and claims. The definitions provided herein should be borne in mind when these terms are used in the following examples and throughout the instant application.

As used herein, the term "mouthpiece" refers to the portion of a bit assembly adapted for being received in the mouth of an animal. Generally, in conventional bit configurations, the mouthpiece is comprised of one or more portions called bars. The central section of the bar or bars may be generally referred to as the barrel or port. Bars may be solid or hollow, constructed of any number of materials, for example, nickel, rubber, silver, stainless steel, and may or may not have apertures therethrough for adaption to positive reinforcement training systems. Further, a plethora of conventional bit configurations include additional elements mounted between the bars, for example, one or more O-ring, french links, rollers, and barrels. Each of these elements is an aid for achieving a specific object of the bit configuration. For example, rollers are generally used to calm nervous horses.

As used in this invention, the term "cheek pieces" refers to the portion of a bit assembly laterally located and mounted on either end of the mouthpiece. The cheek pieces may be configured, for example, in ring member style, loose or fixed, or may be configured in a shank style, rotatable or fixed. Any of known standard cheek piece configurations is adaptable for use with the instant invention.

The term "bushing," as used herein refers to the novel, internally disposed, rotatable bushing/coupler device. "Internally disposed" means that the bushing device is contained within the bar of the bridle bit; only a smooth rotation seam is perceivable by either tactile or visible sensation. A "limiter" is an additional element, for example, a split O-ring, added to the bushing construction that limits the rotational movement of the coupler device. Alternatively, rotation may be limited by a machined stop. For example, the point of contact between the shaft of the bushing and the cheek piece may be machined such that corresponding rotational stops functionally interact in use.

The present invention provides a bridle bit for the control and correction necessary for behavior modification training of, for example, horses. It is recognized by those skilled in the art that a broad range of training methodologies and alternative uses of the bit may be performed in accordance with the present invention. Uses may include alternative training techniques, alternative bit configurations, alternative use with any animal capable of accepting a bit, or any number of other uses not explicitly discussed herein. Generally, the present invention is useful for pinch and/or pain free bit communication between a rider or driver and a trainee animal.

In its broadest embodiment, the pinchless bit comprises a bitting mouth piece or pieces, cheek pieces having rein and head stall connection means, e.g., O rings, D rings, or shanks. Said mouth pieces may be solid or hollow for any number of purposes, for example, weighting, and have internally disposed bushing or bushings coupling rotatable mouthpiece sections together. Said mouthpiece section may be coupled centrally with a single bushing, or alternatively, coupling may employ a plurality of bushings internally disposed on the bar or bars of the mouthpiece on one or more points located laterally between the cheek pieces. Said bushings providing an internal means of rotational movement to the mouthpiece.

In an alternate embodiment, one or more spring elements are functionally incorporated into the bushing. Said spring element or elements automatically return the mouthpiece portions of the bit to their original position in the animal's mouth upon release of the engaging rein. Further, said spring element or elements provide a means for independently engaging a portion or portions of the bit.

Figure 2:
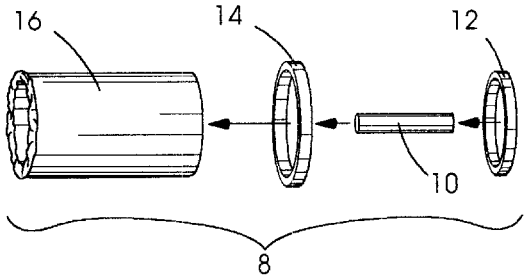
FIG. 2 is an exploded view of the portion indicated by the section line 2—2 in FIG. 1, illustrating the inner shaft and sleeves comprising the internal rotatable coupler (bushing) disposed within the mouth bar or bars.

The first preferred embodiment of the device disclosed herein, a pinchless snaffle, as shown in FIG. 1, has two internally disposed bushings as shown in FIG. 2. A solid mouthpiece bar 18 couples to the bushing sleeve 16. Within the bushing sleeve 16 is contained an internal sleeve ring 14 that prevents a shaft sleeve 12 from continuing through the bushing device 8 itself, thus, acting as a block. The shaft sleeve 12 is mounted or joined to a shaft 10, preferably metal, that passes through the internal sleeve ring 14 and extends out through the bushing sleeve 16, connecting to, via, for example, welding, a center snaffle O-ring 22. Opposite the end of mouthpiece bar 18 having a bushing 8 mounted therein, the bar 18 connects to a cheek piece, for example, a D-ring member 20, to which is accordingly attached the reins and head stall of a bridle assembly.

In use, when properly assembled with reins and a head stall, the mouthpiece bars 18 function independently of each other. That is to say, when the rider or trainer engages a rein, for example, the left rein, the corresponding left-half of the bit responds by rotating in an amount in direct proportion to the amount of engagement by the rider or trainer. When both reins are engaged simultaneously, the bit functions as a conventional bit absent pinching action.

Figure 3:
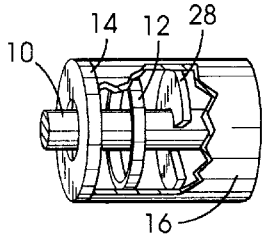
FIG. 3 depicts an alternate embodiment of the novel bushing further comprising a limiter such that the movement of the bushing is restricted from 360 degrees to less than one full rotation.

FIG. 2 depicts the preferred embodiment of bushing device disclosed herein, however, numerous bushing variations are both envisioned and possible, provided they are adaptable to internal bar mounting. In general, the bushing is constructed and/or joined to the remainder of the bit assembly by welding. An alternate embodiment of the novel bushing disclosed herein is seen in FIG. 3. This embodiment is identical to the previously discussed bushing and further comprises a limiter 28. That is, an additional piece of construction, for example, a split sleeve ring that limits the rotational movement of the bushing to less than one full rotation of 360 degrees.

Figure 4:
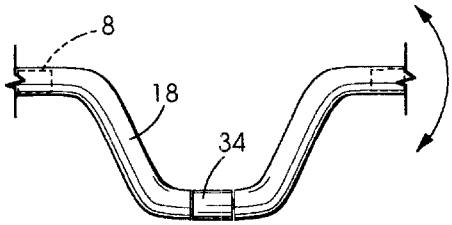
FIG. 4 illustrates an alternate embodiment of the present invention integrating a standard hidden mullen bit configuration with the novel bushing aspects of the instant invention.

FIGS. 4–14 illustrate alternative embodiments of the bushing:bit configuration integration. As shown in FIG. 4, a hidden mullen barrel configuration of bit is adapted to use with the instant bushing invention. Located at the center of a split bar 18 is a mullen barrel 34; coupled to the bar laterally in both directions, located between the bit's port and the cheek pieces, are a plurality of internally disposed bushings 8.

Figure 5:
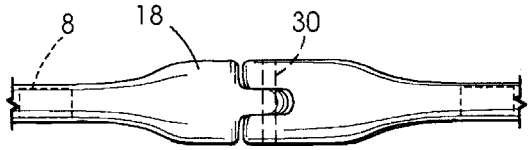
FIG. 5 illustrates an alternate embodiment of the present invention integrating a standard hinged snaffle bit configuration with the novel bushing aspects of the instant invention.
Figure 6:
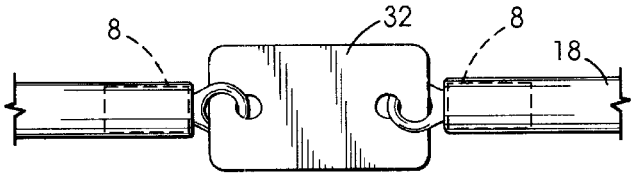
FIG. 6 illustrates an alternate embodiment of the present invention integrating a standard french link snaffle bit configuration with the novel bushing aspects of the instant invention.

A conventional hinged snaffle bit configuration integrating the bushing 8 is seen in FIG. 5. Here, located at the center of a split bar 18 is a snaffle hinge 30 to which, laterally in each direction, is disposed an internal bushing 8 within the bar of the bit. In similar fashion, a french link configuration integrates the same features. See, FIG. 6. A french link is especially adaptable for use with the embodiment comprising a bushing and a limiter, based on the standard use of such a bit.

Figure 7:
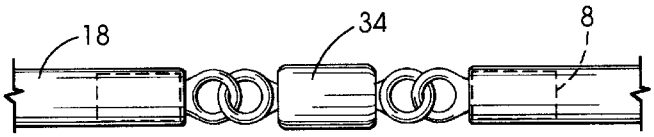
FIG. 7 illustrates an alternate embodiment of the present invention integrating a standard snaffle barrel bit configuration with the novel bushing aspects of the instant invention.
Figure 8:
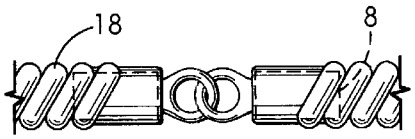
FIG. 8 illustrates an alternate embodiment of the present invention integrating a standard wire twist bit configuration with the novel bushing aspects of the instant invention.
Figure 9:
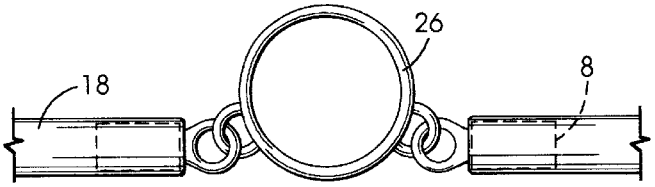
FIG. 9 illustrates an alternate embodiment of the present invention integrating a standard 0-ring snaffle bit configuration with the novel bushing aspects of the instant invention.
Figure 10:
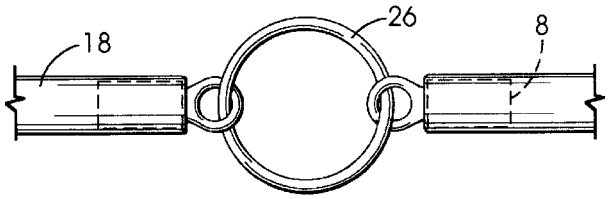
FIG. 10 illustrates an alternate embodiment of the present invention integrating a standard life saver bit configuration with the novel bushing aspects of the instant invention.

FIG. 7, a snaffle barrel 34, is adapted to use with both the standard bushing and/or the bushing plus limiter, disclosed herein.

FIGS. 8–10 and 13 depict the integration of bushings and standard wire twist, O-ring snaffle and life saver bits, wherein the central feature of the bit is flanked on either side by a bushing 8. The life saver bit is particularly adaptable for use with a limiting bushing.

Figure 11:
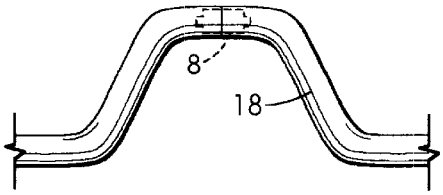
FIG. 11 illustrates an alternate embodiment of the present invention integrating a standard ported curb bit configuration with the novel bushing aspects of the instant invention.
Figure 12:
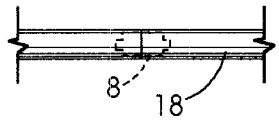
FIG. 12 illustrates an alternate embodiment of the present invention integrating a standard straight curb bit configuration with the novel bushing aspects of the instant invention.
Figure 13:
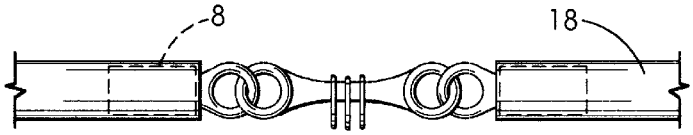
FIG. 13 illustrates an alternate embodiment of the present invention integrating a standard snaffle with 0-rings bit configuration with the novel bushing aspects of the instant invention.

FIGS. 11 and 12 show the integration of the bushing 8 into the center of a low, medium or high port bar 18 by splitting the bar. Thus, in a high port bit for use with tongue sensitive horses, for example, the port functions as in a conventional bit configuration, however, the rider or driver may independently work either half of a bit that, heretofore, always functioned as a whole.

Figure 14:
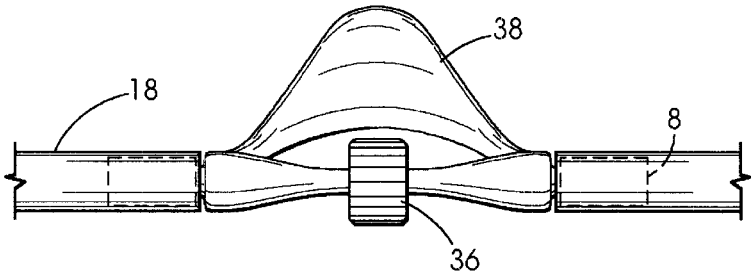
FIG. 14 illustrates an alternate embodiment of the present invention integrating a standard half-breed correctional bit configuration with the novel bushing aspects of the instant invention.

FIG. 14, a half breed correctional bit is particularly adaptable for use with a limiter bushing 8. By flanking the center roller 36 and plate 38 portion of the bit with limiter bushings 8 in the bar, the engagement of the bit makes the chain of the bridle assembly hit the chin of the horse first. If the horse doe not respond to the command, the rider or driver "picks up" the rein and the plate engages the hard palate of the animal.

Figure 15A:
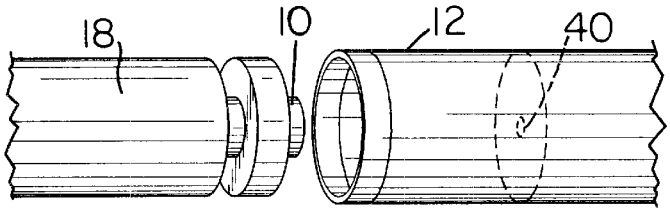
FIGS. 15*a*–15*d* illustrate alternate solid, die-cast bushings for use in conjunction with bits encompassed by the instant invention.
Figure 15B:
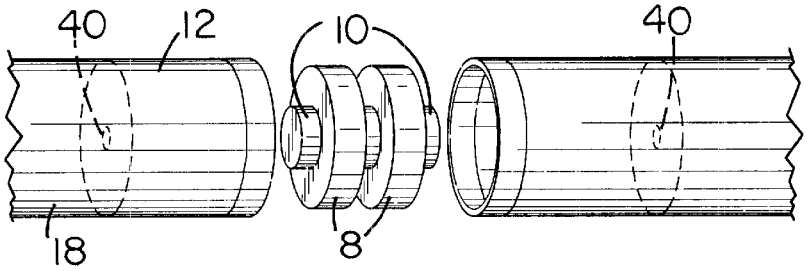

FIGS. 15*a*–*d* depict further alternate embodiments of bushings 8. More specifically, the bushings 8 are solid die-cast portions of the bar 18 that are positioned and welded into a sleeve 12 in order to achieve their internal disposition. For example, in FIG. 15*a*, the die-cast bushing 8 integrally forms the bushing shaft 10 that inserts into a shaft aperture 40 by which the bushing is shored up, or strengthened. FIG. 15*b* illustrates the same concept, solid die-cast bushing 8 and shaft 10, applied to a bit employing 2 points of rotation. Similarly, FIG. 16 couples a spring element 42 with the double bushing embodiment of FIG. 15*b*. To do so, after placing the spring element 42 about the shaft 10, one end of the spring element 42 is mounted at a first, spring element stop 44. The opposite end of the spring element 42 is mounted at a second, spring element stop 46. The spring element stops 44, 46 mount and retain the spring element 42 in place, and thus, maintain the spring action of said spring element 42. In use, the spring element 42 acts to facilitate independent function of each portion of the bit and to return said portions to their original positions subsequent to use. That is to say, the left bar 18 and cheek piece 66 may be engaged independent of the right bar 18 and cheek piece 66, by independent use of the engaging members—the right and left reins. By engaging both reins simultaneously, the bit functions as a single unit and the spring element 42 is not engaged.

Figure 15C:
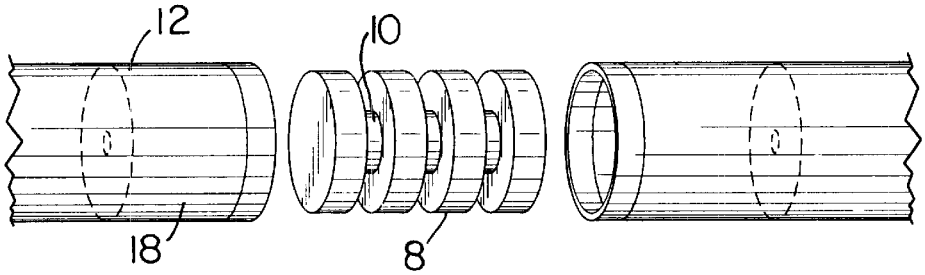
Figure 15D:
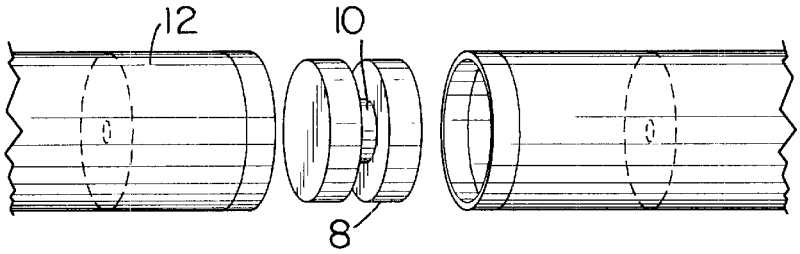
Figure 16:
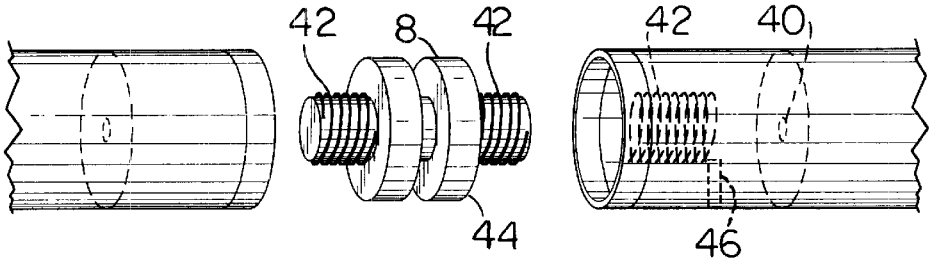
FIG. 16 is an exploded view of the portion indicated by the section line 2—2 in FIG. 1 of a bit of the instant invention further comprising at least one spring element, thus, illustrating the inner shaft and sleeves comprising the internal rotatable coupler (bushing) and spring elements disposed within the mouth bar or bars of a bit.

FIGS. 15*c* and 15*d* are directed to solid die-cast bushings 8 as well. Said bushings 8 are cast without a shaft 10 portion extending from either end. Still, they insert into the bar 18 and are accordingly internally disposed and functional in a fashion similar to that described supra.

Figure 17:
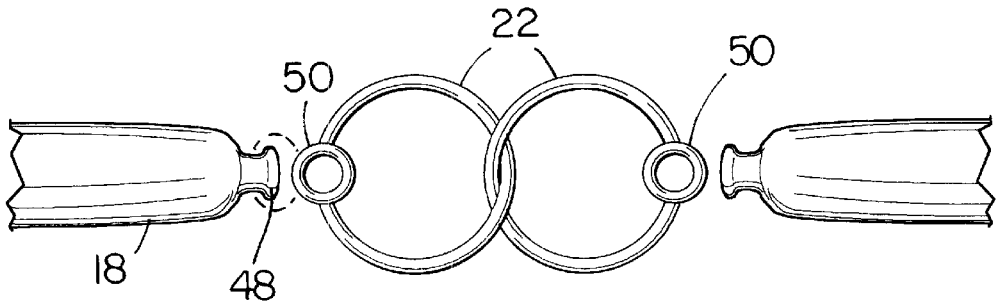
FIG. 17 depicts an alternate, bushing free, pinchless bridle bit wherein rotation is achieved via a freely rotating male:female type connection between snaffle rings and bit bars.
Figure 21A:
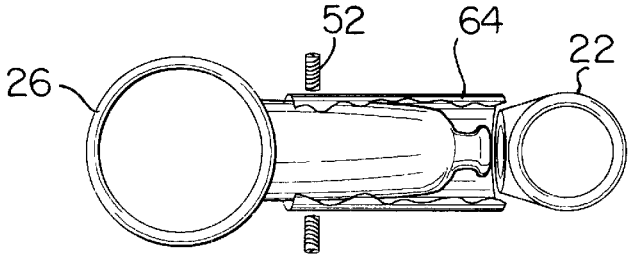
FIGS. 21*a*–*b* depict an alternate, bushing free, pinchless bridle bit wherein rotation is achieved via a freely rotating male: female type connection between snaffle rings and bit bars and further comprises an outer sleeve positioned to cover the entire bar.
Figure 21B:
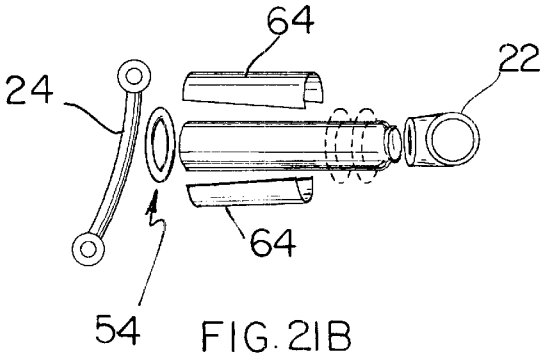

It is envisioned that numerous rotating and/or non-pinching bit assemblies may be created in accordance with the requirements and limitations set forth herein. For example, FIG. 17 sets forth just such one embodiment; no bushing, as disclosed herein, is employed in this embodiment that fulfills the rotational and pinchless requirements of the instant invention. Specifically, the mouth bar 18 is manufactured such that a male, peg-shaped element 48 couples with a female coupler ring element 50. Said female element 50 is integrally combined with center O-rings 22 generally employed in a snaffle-type bit. The male:female coupling allows for 360°, pinchless rotation of the central portion of the bit. This embodiment may further comprise an external protective sleeve 64 covering the entire bar 18 of the mouthpiece; extending from the cheekpiece 66 to the center O-rings 22 and stabilized by a plurality of alien screws 52 and a sleeve ring 54 adapted thereto, as shown in FIGS. 21*a*–*b*. The external protective sleeve 64 may be employed, for example, to protect an animal's mouth.

Figure 18:
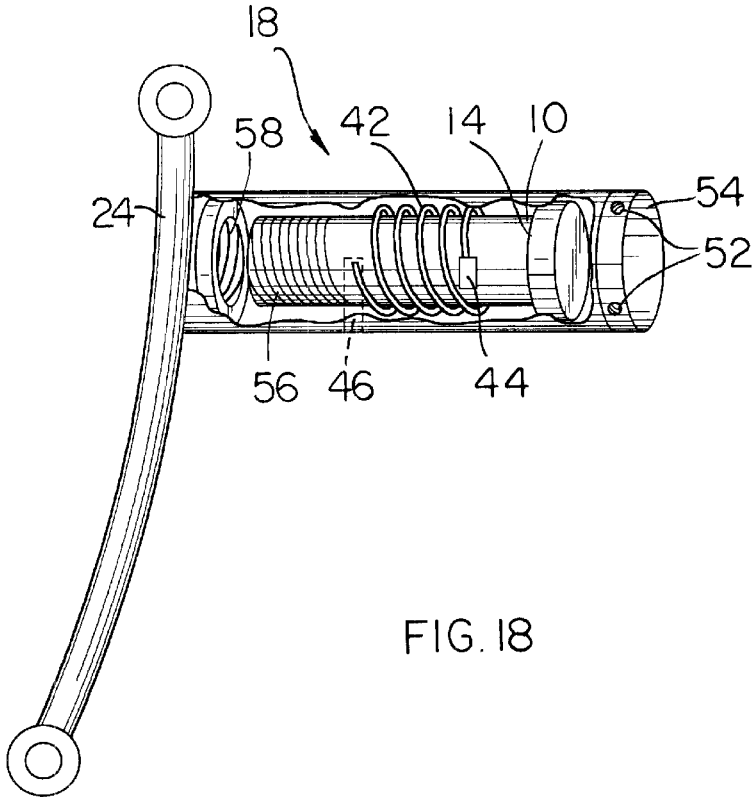
FIG. 18 is a perspective view of the bit mouth piece of an alternate preferred embodiment of the present invention further comprising at least one internally disposed spring element.

Moving to FIG. 18, a spring back bushing is depicted as combined with a standard shanked bit. The shaft 10 inserts into the mouth bar 18; said shaft having screw grooves 56 on the end that contacts the cheek piece 66, in this figure a shank ring member 24, and said cheek piece 66 having corresponding screw bores 58 therein, such that the shaft 10 screws into the cheek piece 66. More specifically, the shaft 10 comprises a spirally grooved solid cylinder designed to be inserted by rotational movement, as generally used to fasten together solid pieces of material. Screw bores 58 include any correspondingly grooved hollow cylinder into which the grooved solid cylinder fits by means of a twisting or screwing rotation. About the shaft 10 is a spring element 42, one end of which is attached to a first spring element stop 44, the opposite end of which is attached to a second spring element stop 46. Each point of attachment or insertion, 44 and 46, acts as a spring stop; keeping the spring in place and retaining its resilient characteristics. Said spring stops 44, 46 may comprise, for example, weld points of attachment or, preferrably, machined apertures into which the spring element 42 is inserted. This embodiment further comprises a removable outer sleeve ring 54 that is kept in place with alien screws 52, thus, enabling the replacement of the spring element 42.

Figure 19:
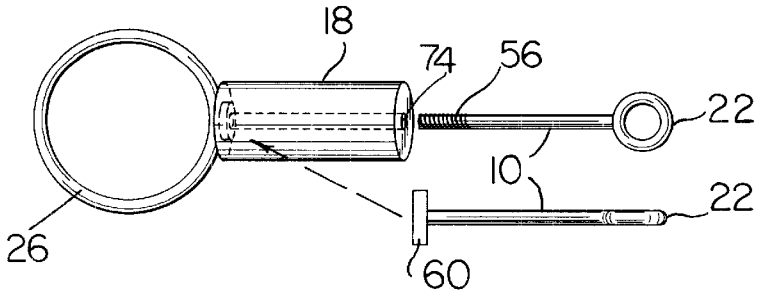
FIG. 19 illustrates an alternate embodiment of a rotatable coupler incorporated into a snaffle bit.

FIG. 19 depicts an alternate type of internally disposed rotatable coupler in an O-ring snaffle type bit configuration. The bar 18 of the mouth piece has a bar aperture 74 bored therethrough, through which a shaft 10 is inserted. The shaft 10 may have screw grooves 56 on one end and a welded center O-ring 22 on the opposite end thereof. The shaft screw grooves 56 correspond to groove bores 58 in a lip 60 which is rotationally mounted to the shaft 10 after its insertion through the bar aperture 74 and prior to welding the O-ring cheekpiece member 26 to the bar 18. Alternatively, the shaft 10 may be machined or cast with a lip 60. The shaft 10 is inserted through the bar aperture 74 prior to center O-ring 22 mounting. Thus, rotational movement is achieved by an internally disposed rotational shaft.

Figure 20:
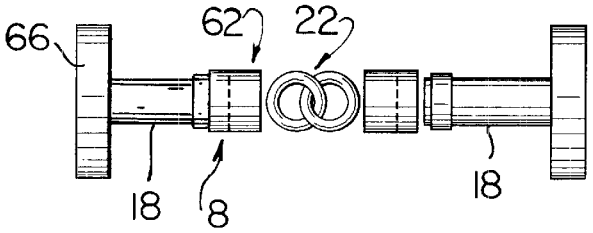
FIG. 20 depicts an alternate embodiment of an internally rotatable coupler wherein said internal bushing's outer sleeve is attached, i.e., welded, directly to the central mouthpiece rings of a bit.

An alternate embodiment of the first preferred embodiment is illustrated in FIG. 20. While still employing an internally disposed rotatable coupler or bushing 8, the center O-rings 22 are mounted directly to an external bushing sleeve 62 rotably attached exterior of the mouth bar 18. Said external bushing sleeve 62 rotates in conjunction with the center bit element or elements.

Figure 22:
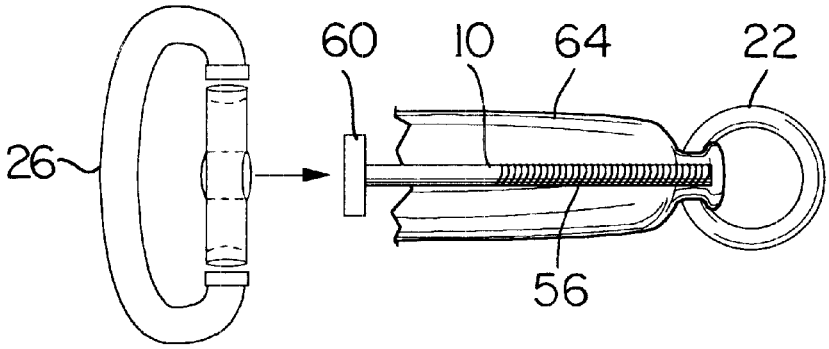
FIG. 22 illustrates an alternate embodiment of a rotatable coupler incorporated into a snaffle bit and further comprises an outer sleeve positioned to cover the entire bar.
Figure 23:
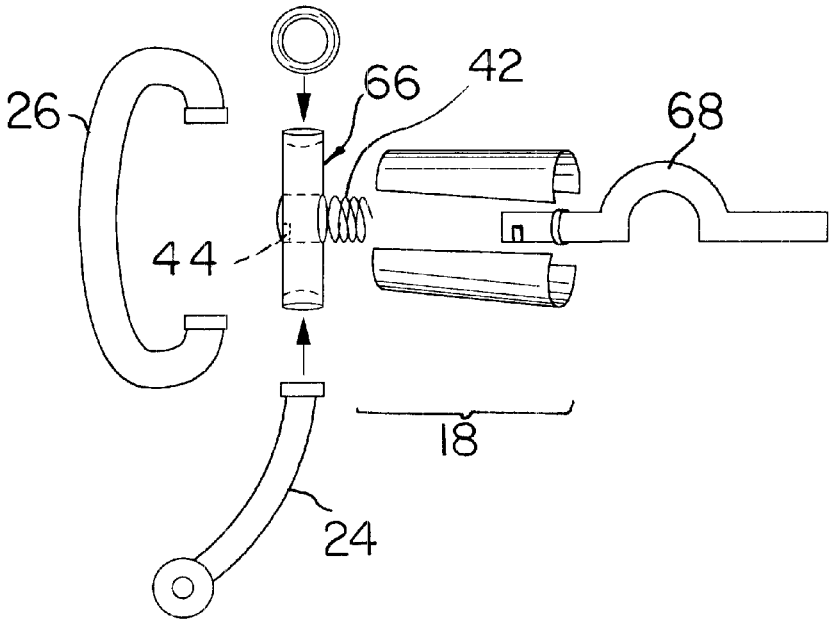
FIG. 23 illustrates the alternate rotatable coupler depicted in FIG. 22 incorporated into a ported curb-type bit configuration and further comprising at least one spring element functionally combined therewith.

A rotational shaft type coupler bit assembly having conventional rotatable cheekpieces and further comprising an external protective sleeve 64 is depicted in FIG. 22. In FIG. 23, a ported bit comprising a plurality of bushings 8 and a plurality of spring elements 42 functionally combined with conventional rotatable cheekpieces 66 is illustrated. Said bit is comprised of 3 portions: a right bar, a port or bridge, and a left bar. Each of the bars 18 comprises the rotational portion of the bit assembly via an internal bushing coupler 8 positioned between and connecting the bar 18 and port 68 portions. The bushing 8 further comprises a spring element 42, one end of which is attached to a first spring element stop 44 at the bar and the other or opposite end attached to a second spring element stop 46 at the cheekpiece.

Yet another alternate embodiment of an internal bushing is shown in FIGS. 24*a* and 24*b*. The bars 18 of the bit are solid material with a machined, generally cone-shaped portion extending from the end opposite the end upon which the cheekpieces are mounted. In FIG. 24*a*, an internal sleeve ring 14 is mounted, for example welded, onto the cone-shaped portion, over which a lipped conical bushing sleeve 16 is mounted. The bushing sleeve 16 is formed from 2, lipped, half sleeves 70; each of which is welded to the other after functionally mounting the lipped portion over the internal sleeve ring 14. Once welded together, the bushing sleeve is welded directly to, for example, center O-rings 22. Alternatively, FIG. 24*b* depicts a bushing 8 as disclosed in the preferred embodiment adapted for combination with a solid, machined bar 18.

On occasion, welding of the particular pieces of a bit assembly results in the overheating of the internal workings. In particular, overheating of the spring element results in its non- or mal-functioning in its springing action. To overcome this problem, the bushing 8, spring element 42, bar 18 and cheekpiece 66 may be fit together, welded at the central bar area and an outer sleeve 64 attached with allen screws 52, as shown in FIG. 25.

Figure 26:
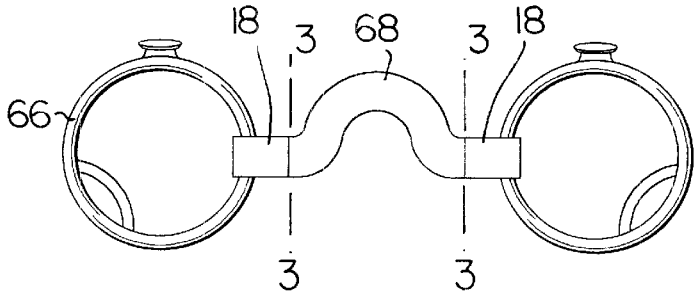
FIG. 26 is an external perspective view of a ported bit incorporating the novel bushing and spring elements of the instant invention.
Figure 27:
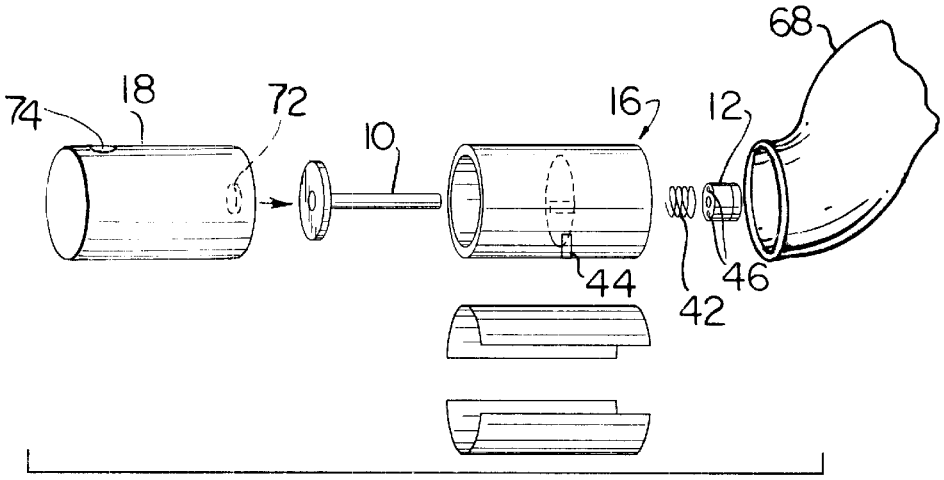
FIG. 27 is an exploded view of the portion indicated by the section line 3—3 in FIG. 26, illustrating the inner shaft and sleeves comprising the internal rotatable coupler (bushing) as well as the spring element disposed within the mouth bar or bars.

Another preferred embodiment is depicted in FIGS. 26 and 27. FIG. 26 illustrates a bit that, at first blush, appears to be a conventional solid barred bit. Two bushings 8 internally disposed at section lines 3—3 enable independent rotational movement of portions of the bit. For example, engagement of the left rein when properly attached to the left cheek piece 66 rotates the left bar 18 and the port portion 68 as a single portion, independent of the right bar 18. The same type of bit portion movement on the right portion of the bit assembly is possible by engaging only the right rein. However, engagement of both reins simultaneously moves the bit as a whole in precisely the same manner as a solid bit without rotational means would move. In FIG. 27, the internal rotational, i.e., bushing 8 and spring element 42 means are disclosed. Moving from left to right in the figure, the mouth bar 18 is adapted to receive, for functional combination, a cheekpiece 66, either an O-ring member 26 or shank ring member 24. Said adaption includes, for example, an aperture 74 therethrough, through which the cheekpiece is mounted. The end of the mouth bar 18 opposite the cheekpiece 66 is manufactured such that an integral shaft stop 72 corresponds to and functionally combines with an integral shaft stop 72 on the rotational shaft 10 of the bushing 8. The shaft 10 passes through the bushing sleeve 16, spring element 42, and shaft sleeve 12. The bushing sleeve 16 and the mouth bar 18 are then welded together forming the bar 18, either left or right, of the bit. Located on the interior of the bushing sleeve 16 is a spring element stop 44, for example an aperture, into which one end of the spring element 42 is inserted. The opposite end of the spring element 42 is inserted into a second spring element stop 46 in the shaft sleeve 12. Said shaft sleeve 12 is mounted on, for example welded, the port or bridge portion 68 of the bit and the end of the shaft 10 extending therethrough is welded into position. Thus, all rotational and spring means are concealed within the bar 18 of the bit; the bar 18 and bushing sleeve 16 moving as a singleunit and the shaft 10, spring element 42, shaft sleeve 12 and port 68 rotate as one. Following the same procedure on the opposite end of the port or bridge portion 68 of the bit produces a three sectioned, dually rotational bit assembly.

In use, the shaft 10 remains stationary when a single rein is used to engage the bit assembly, while the bushing sleeve 16 rotates. When properly assembled with reins and a head stall, a bar 18 in conjunction with the port portion 68 of the bit functions independently of the other bar portion 18. That is to say, when the rider or trainer engages a rein, for example, the left rein, the corresponding left bar 18 and the port 68 respond by rotating in an amount in direct proportion to the amount of engagement by the rider or trainer. However, when both reins are engaged simultaneously, the bit functions as a conventional solid bit.

Figure 28A:
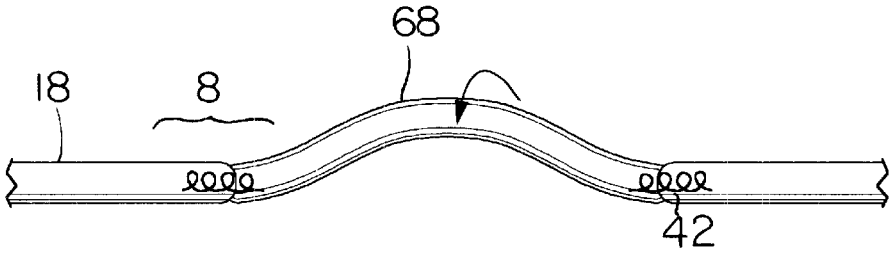
FIG. 28*a*–28*c* depict alternated embodiment of the preferred spring element embodiment of the instant invention integrating standard ported bit configurations with the novel bushing and spring aspects of the instant invention.
Figure 28B:
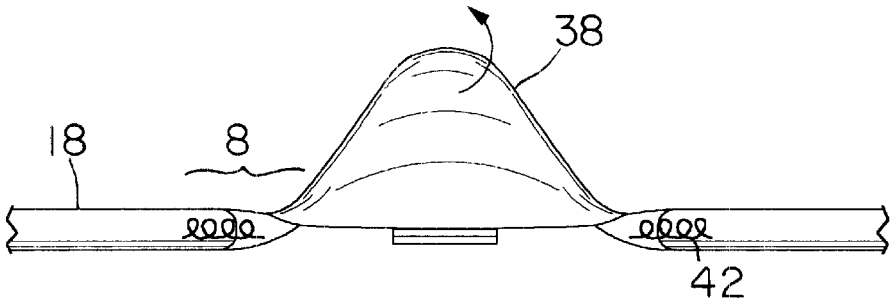
Figure 28C:
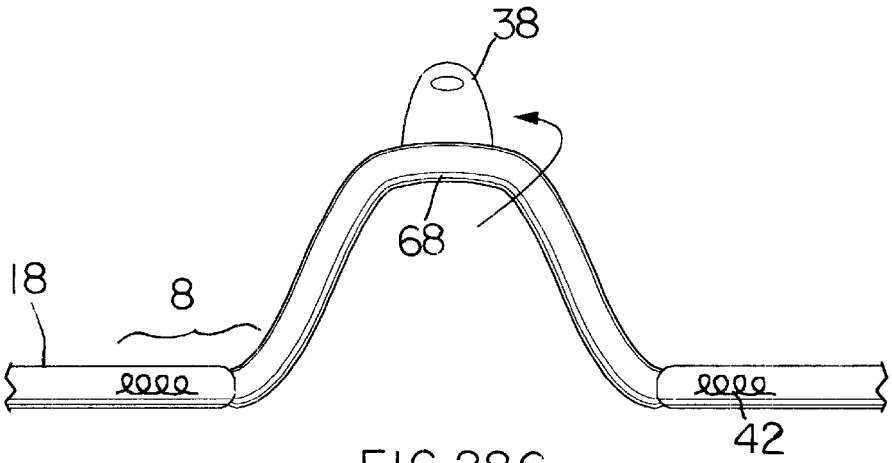

Alternate embodiments of the preferred spring element embodiment are illustrated in FIGS. 28*a–c*, wherein the embodiment of FIG. 27 integrates standard ported bit configurations with the novel bushing and spring aspects of the instant invention. Each of the bits in FIGS. 28*a–c* have a central feature, for example a port 68 or plate 38 portion of the bit that is flanked on either side by a bushing 8.

The method and apparatus disclosed herein provides for a training and behavior modification bridle bit assembly. Further, this device significantly reduces stresses placed on the horse in training, while improving the performance and learning potential of same.

While the above description contains many specificities, these should not be construed as limitations on the scope of the invention, but rather an exemplification of the preferred embodiment thereof. Many other variations are possible. Thus, the scope of the invention should be determined by the appended claims and their legal equivalents, rather than by the examples given.

What is claimed is:

1. A bridle bit comprising: a mouthpiece, said mouthpiece having one or a plurality of bars adapted to be received in the mouth of an animal and having laterally extending ends; one or a plurality of rotatable bushings internally disposed within said mouthpiece, said bushing or bushings further comprising at least one spring element disposed therein and at least one stop at ends of said one or a plurality of rotatable bushings to retain said at least one spring element in place, and thus, maintain the spring action of said at least one spring element; and a plurality of cheek pieces mounted to the laterally extending ends of said bar or bars.

2. A bridle bit as defined in claim 1 wherein said one or a plurality of bushings further comprises a limiter portion thereby limiting rotation of said one or a plurality of bushings from 0 up to 360 degrees.

3. A bridle bit as defined in claim 1 wherein said mouthpiece further comprises one or a plurality of bitting elements disposed and mounted between the plurality of cheek pieces.

4. A bridle bit as defined in claim 2 wherein said mouthpiece further comprises one or a plurality of bitting elements disposed and mounted between the plurality of cheek pieces.

5. A bridle bit as defined in claims 3 or 4 wherein said bitting element or elements is selected from a group consisting of ring, link, cricket, roller and joint.

6. A bridle bit as defined in claim 1 wherein said a plurality of cheek pieces are rotatably mounted to the laterally extending ends of said bar or bars.

7. A bridle bit as defined in claim 1 wherein said a plurality of cheek pieces are fixedly mounted to the laterally extending ends of said bar or bars.

* * * * *